US005394717A

United States Patent [19]

Yu

[11] Patent Number: 5,394,717

[45] Date of Patent: Mar. 7, 1995

[54] SECURITY LOCK

[76] Inventor: Sandy T. S. Yu, 8640 Heather Street, Richmond, British Columbia, Canada, V6Y 2R5

[21] Appl. No.: 79,945

[22] Filed: Jun. 23, 1993

Related U.S. Application Data

[63] Continuation-in-part of Ser. No. 941,639, Sep. 9, 1992, abandoned.

[51] Int. Cl.[6] ..... E05B 47/00

[52] U.S. Cl. ..... 70/276; 70/472; 292/251.5; 292/DIG. 27

[58] Field of Search ..... 70/276, 413, 472, 142, 70/218, 223; 292/251.5, DIG. 27, DIG. 62

[56] References Cited

U.S. PATENT DOCUMENTS

| | | | |
|---|---|---|---|
| 3,785,188 | 1/1974 | Drathschmidt | 70/276 |
| 3,857,262 | 12/1974 | Sidiropoulos | 70/276 |
| 3,967,479 | 7/1976 | Vick | 70/413 |
| 3,974,669 | 8/1976 | Stackhouse | 70/276 |
| 4,003,152 | 1/1977 | Barker et al. | 42/70.11 |
| 4,067,132 | 1/1978 | Smith | 42/70.11 |
| 4,105,885 | 8/1978 | Orenstein | 42/70.11 |
| 4,135,320 | 1/1979 | Smith | 42/70.01 |
| 4,154,014 | 5/1979 | Smith | 42/70.06 |
| 4,307,589 | 12/1981 | Kajita | 70/276 |
| 4,354,189 | 10/1982 | Lemelson | 42/70.11 |
| 4,416,127 | 11/1983 | Gomez-Olea Naveda | 70/278 |
| 4,457,091 | 7/1984 | Wallerstein | 42/70.11 |
| 4,467,545 | 8/1984 | Shaw, Jr. | 42/70.11 |
| 4,488,370 | 12/1984 | Lemelson | 42/70.11 |
| 4,682,435 | 7/1987 | Heltzel | 41/70.01 |
| 5,016,376 | 5/1991 | Pugh | 42/70.11 |
| 5,062,232 | 11/1991 | Eppler | 42/70.11 |
| 5,123,193 | 6/1992 | Pugh | 42/70.11 |
| 5,192,818 | 3/1993 | Martin | 42/70.01 |

FOREIGN PATENT DOCUMENTS

| | | |
|---|---|---|
| 0262262 | of 0000 | European Pat. Off. . |
| 1297090 | of 0000 | France . |
| 8334889 | of 0000 | Germany . |
| 06956 | of 0000 | United Kingdom . |
| 23564 | of 0000 | United Kingdom . |

*Primary Examiner*—Peter M. Cuomo
*Assistant Examiner*—Darnell M. Boucher
*Attorney, Agent, or Firm*—Bull, Housser & Tupper

[57] ABSTRACT

An apparatus for controlling a primary actuator comprises a primary moveable link connected to the primary actuator, a secondary actuator, and a secondary moveable link connected to the secondary actuator. The secondary moveable link is engageable and disengageable with the primary moveable link and the primary and secondary links are guided for movement along a predefined path. The user of the apparatus is able to control the engagement and disengagement of the primary and secondary links such that movement of the secondary actuator is transferred to the primary actuator when the links are engaged and such that movement of the secondary actuator is not transferred to the primary actuator when the links are disengaged.

20 Claims, 9 Drawing Sheets

SECURITY LOCK

CROSS REFERENCES TO RELATED APPLICATIONS

This is a continuation-in-part of my prior U.S. patent application Ser. No. 07/941,639, now abandoned filed Sep. 9, 1992.

BACKGROUND OF THE INVENTION

This invention relates to locks and the like, with particular application to a safety lock for a gun and has other applications for controlling the locking and unlocking of a briefcase or drawer, for example.

Various locking devices exist for controlling the operation of various types of mechanisms. One of the most common locking mechanisms is the conventional key lock. A conventional key lock is, however, not practical for controlling the operation of a gun because a two step procedure would be required to operate the gun; first, the key must be turned to deactivate a locking mechanism and secondly the trigger of the gun must be pulled in order to fire a projectile. This, of course, would not be practical in cases where the gun is in the hands of a policeman, as for this application the gun must be ready at all times.

Various locking devices for controlling the operation of a gun have been developed, some of which are described in U.S. Pat. Nos. 4,067,132, 4,135,320 and 4,154,014, all to Smith. Basically, each of these references discloses a weapon locking device employing a magnetic ring worn by a user of the device and a magnetically responsive member inside the weapon which is moved into or out of an interfering relationship with a working part of the weapon by the magnetic influence of the ring worn by the user. A devious user could, however, activate the mechanism simply by lashing a magnet in the vicinity of the magnetically responsive member thereby permanently enabling the gun to be fired.

Other attempts to control the actuation of a gun have been disclosed by U.S. Pat. No. 4,003,152 to Barker et al, U.S. Pat. No. 4,105,885 to Ornstein, U.S. Pat. No. 4,354,189 to Lemmelson, U.S. Pat. No. 4,457,091 to Wallerstein, U.S. Pat. No. 4,467,545 to Shaw Jr., U.S. Pat. No. 4,488,370 to Lemmelson, U.S. Pat. No. 5,016,376 and U.S. Pat. No. 5,123,193 both to Pugh, U.S. Pat. No. 5,062,232 to Eppler and U.S. Pat. No. 5,192,818 to Martin. Each of the devices described in the immediately above patents, however, employs an electrical circuit for actuating a solenoid connected to the firing mechanism of the firearm. Of course, the use of an electrical circuit requires electrical power, usually in the form of a battery and batteries are susceptible to depletion and require replacement from time to time. Thus, maintenance on the firearm is increased.

There exists, therefore, a need for a device for controlling the actuation of an actuator, requiring no electrical power and/or more difficult to defeat than the Smith devices. The present invention addresses such a need.

SUMMARY OF THE INVENTION

According to one aspect of the invention there is disclosed an apparatus for controlling a primary actuator comprising a primary moveable link connected to said primary actuator, a secondary actuator, a secondary moveable link connected to said secondary actuator, the secondary moveable link being engageable and disengageable with the primary moveable link, guiding means for guiding the movement of said primary and secondary links along a pre-defined path, controlling means for controlling the engagement and disengagement of the primary and secondary links whereby movement of said secondary actuator is transferred to said primary actuator when said links are engaged and movement of said secondary actuator is not transferred to said primary actuator when said links are disengaged.

Preferably, the apparatus includes a first magnet on the secondary moveable link and a cooperating magnet secured to a ring worn on a finger of a user of the apparatus. Also preferably, the secondary actuator and the primary and secondary links are positioned on the apparatus such that the user can simultaneously position the first cooperating magnet adjacent the second moveable link and actuate the secondary actuator, all using only one hand.

Also preferably, the apparatus includes an intermediate moveable link disposed between the primary and secondary moveable links and guided by the guiding means. Preferably the intermediate moveable link has an intermediate moveable portion which is guided in movement perpendicular to a movement plane. Also preferably the intermediate moveable link has first and second opposite end portions, the first end portion having an intermediate opening therein and the second end portion having an intermediate projection, the intermediate opening being operable to receive a primary projection extending from the primary link and the intermediate projecting being operable to be received in a secondary opening in the secondary moveable link.

Preferably the intermediate moveable link has a second magnet connected thereto, the second magnet having a polarity opposite to the polarity of the first magnet connected to the secondary moveable link. With such first and second magnets, preferably the controlling means includes first and second cooperating magnets on first and second rings worn on first and second fingers on the hand of a user of the apparatus. Preferably the first and second cooperating magnets have opposite polarity such that each attracts its respective corresponding magnet on said links when the user places the first and second rings adjacent the secondary and intermediate links respectively.

According to another aspect of the invention there is provided a method for controlling a primary actuator, the method comprising the steps of:

a) placing a ring carrying a first cooperating magnet on a first finger of a hand of an operator;

a) gripping an apparatus having plurality of moveable, engageable links including a primary link connected to said primary actuator and a secondary link connected to a secondary actuator, such that said first magnet is placed adjacent at least one of said primary and secondary links such that said primary and secondary links become engaged; and c) squeezing said hand about said apparatus to move said secondary actuator, whereby movement of said secondary actuator is transferred to said primary actuator by said primary and secondary links.

According to a further aspect of the invention there is provided an apparatus for controlling a primary actuator, the apparatus comprising a primary moveable link connected to the primary actuator, a secondary actuator, a secondary moveable link connected to the secondary actuator, a plurality of moveable links selectively engageable with each other and with said primary and secondary moveable links; guiding means for guiding the movement of the primary and secondary links and the plurality of links, along a predefined path; controlling means for controlling the engagement and disengagement of the plurality of moveable links with each other and with the primary and secondary links, whereby movement of the secondary actuator is transferred to the primary actuator when at least some of the links are engaged and movement of the secondary actuator is not transferred to said primary actuator when said some of said links are disengaged.

According to a further aspect of the invention, there is provided a gun comprising:

a) a body having a handle portion;

b) a sear having a firing position in which firing of the gun is enabled and a safety position in which firing of the gun is disabled;

c) a trigger;

d) a trigger bar having first and second end portions, the first end portion being operable to engage said sear and the second end portion being connected to the trigger;

e) a spring biasing the first end portion out of engagement with said sear;

f) a primary actuator for engaging and disengaging the first end portion with the sear;

g) safety means for controlling the primary actuator, the safety means including:

i) a primary moveable link connected to said primary actuator;

ii) a secondary actuator having a portion extending outwardly from the handle portion;

iii) a secondary moveable link connected to said secondary actuator, the secondary moveable link being engageable and disengageable with the primary moveable link;

iv) guiding means for guiding the movement of said primary and secondary links along a pre-defined path, whereby the primary and secondary links may be selectively engaged and disengaged such that when the links are engaged, actuation of the secondary actuator causes the first end portion of the trigger bar to engage the sear and when the links are disengaged, actuation of the secondary actuator has no effect on the engagement of the first end portion with the sear.

Preferably the apparatus further includes controlling means for controlling the engagement and disengagement of the primary and secondary links whereby movement of said secondary actuator is transferred to said primary actuator when said links are engaged and movement of said secondary actuator is not transferred to said primary actuator when said links are disengaged.

Also preferably, the apparatus includes feedback means for providing feedback to an operator of the firearm, indicative of the state of readiness of the firearm.

According to a further aspect of the invention, there is disclosed a method of readying a firearm prior to the operation thereof, the method comprising the steps of:

a) placing first and second rings carrying first and second cooperating magnets respectively, on first and second fingers respectively of a hand of an operator;

a) gripping a handle portion of said firearm such that the operator's first and second fingers place said first and second cooperating magnets adjacent said secondary and said intermediate links respectively, such that said primary and secondary links engage said intermediate link; and c) squeezing said hand about said apparatus to move said secondary actuator, whereby movement of said secondary actuator is transferred to said primary actuator by said primary, secondary and intermediate links.

Preferably, the method includes the step of placing on the operator's first and second fingers first and second rings carrying first and second cooperating magnets having opposite polarity.

Also preferably, the method includes the step of sensing the movement of the primary actuator with a portion of the operator's body normally in contact with the firearm during normal use thereof.

Devices according to the present invention are easily and conveniently fitted into handle portions of conventional firearms and therefore such devices are easily retrofittable.

BRIEF DESCRIPTION OF THE DRAWINGS

In drawings which illustrate embodiments of the invention.

DETAILED DESCRIPTION

FIG. 1

Figure 1:
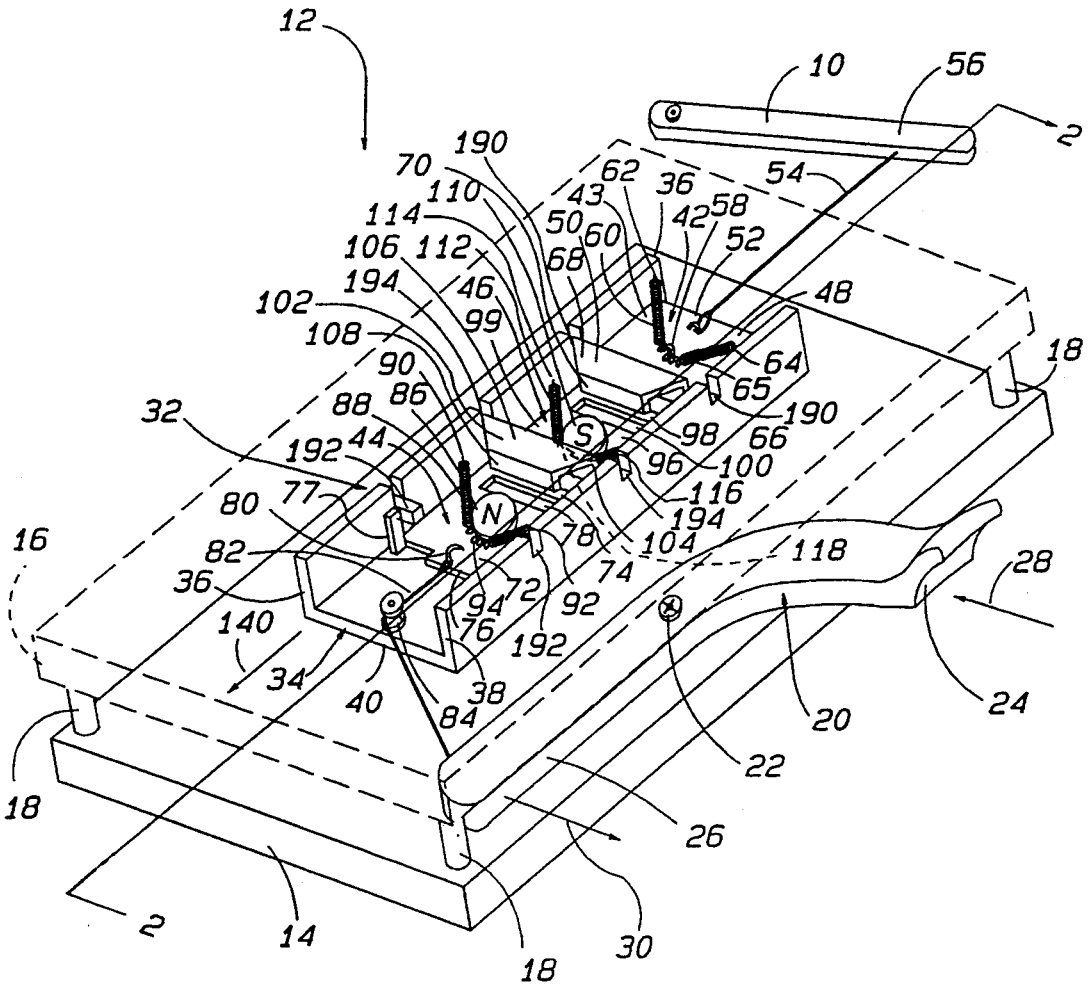
FIG. 1 is a perspective view of an apparatus for controlling a primary actuator according to a first embodiment of the invention.

Referring to FIG. 1, an apparatus for controlling a primary actuator 10 is shown generally at 12. It will be apparent that the primary actuator 10 may be any mechanism for moving or controlling something indirectly instead of by hand. Examples of primary actuators contemplated by the inventor include a spring loaded trigger bar of a gun, a spring loaded lock on a briefcase, and a spring loaded lock on a drawer. The invention will be described in an application where the primary actuator is a spring loaded trigger bar of a gun, but it will be appreciated that the invention is easily adaptable to the applications listed above and to applications generally involving the actuation of an actuator.

The apparatus 12 includes first and second spaced apart mounting plates 14 and 16 respectively, the plates being spaced apart by standoffs 18.

Disposed between the first and second mounting plates 14 and 16 is a secondary actuator shown generally at 20, the secondary actuator being pivotally connected to the first plate 14 by a pivotal connection 22 and the secondary actuator 20 having a first end portion 24 and a second end portion 26 disposed on opposite sides of the pivotal connection 22. The first end portion 24 projects outwardly from the first and second plates 14 and 16 and is operable to be pushed in the direction of arrow 28 to rotate the secondary actuator 20 about the pivotal connection 22 thereby causing corresponding movement of the second end portion in the direction of arrow 30.

Further secured between the first and second mounting plates 14 and 16 is a link assembly shown generally at 32 The link assembly includes an channel member shown generally at 34, the channel member having first and second spaced apart upstanding wall portions 36 and 38 respectively, connected by a plate portion 40. In this embodiment, the link assembly includes a primary moveable link shown generally at 42, a secondary moveable link shown generally at 44 and an intermediate moveable link shown generally at 46.

Primary moveable link

The primary moveable link 42 has a main portion shown generally at 43 and a cooperating portion shown generally at 50. The main portion has an outer end portion 48 to which is connected a hook 52. A primary flexible tension link 54 is connected between the hook 52 and an end portion 56 of the primary actuator 10. Further connected to the main portion is a second hook 58, for cooperating with a primary elastic member 60 having a first end portion 62 connected to the first upstanding wall portion 36, a second end portion 64 connected to the second upstanding wall portion 38 and an intermediate portion 65 directly connected to the second hook 58.

The cooperating portion 50 has an upstanding wall portion 66 which extends vertically upwards at right angles relative to the main portion 43. Connected to the upstanding wall portion is a top portion 68 extending in a plane parallel to the plane of the main portion 43 and connected to the top portion is a primary projection 70 extending downwards, parallel to the upstanding wall portion 66.

The first and second upstanding wall portions 36 and 38, immediately adjacent the upstanding wall portion 66 are formed with respective primary transverse channel tabs 190 which interfere with the main portion 43 to prevent the primary link 42 from lifting out of the channel member 34 during movement.

Secondary moveable link

The secondary moveable link 44 has a main portion 72 having first and second opposite end portions 74 and 76. The first end portion 74 has a transversely extending secondary opening 78 extending therethrough and the second end portion 76 has first and second upstanding tabs, only one of which is shown at 77, and has a hook 80 to which is connected a secondary flexible tension link 82. The secondary flexible tension link 82 is routed past a pulley 84 secured to the plate portion 40 of the channel member 34, and is further connected to the second end portion 26 of the secondary actuator 20.

The secondary moveable link has a first magnet 86 connected thereto, the first magnet having a North pole facing in a vertically upward direction relative to the main portion 72. A secondary resilient elastic member 88 has a first end portion 90 connected to the first upstanding wall portion 36, has a second end portion 92 connected to the second upstanding wall portion 38 and has an intermediate portion 94 extending around a portion of the first magnet 86.

The first and second upstanding wall portions 36 and immediately adjacent the second end portion 76 are formed with respective secondary transverse channel tabs 192 which interfere with the main portion 72 and with the upstanding tabs 77, to prevent the secondary link 44 from lifting out of the channel member 34 during movement of the link and to limit the travel of the link. While the secondary transverse channel tabs 192 perform these functions, they permit sufficient rotational movement of the first end portion 74 relative to the second end portion 76 to allow the secondary link 44 to engage with the intermediate link 46 as will be appreciated below. The first end portion 74 therefore acts as a secondary moveable portion of the secondary link.

Intermediate moveable link

Still referring to FIG. 1, the intermediate moveable link 46 also has a main portion 96 having a first end portion 98 with a transversely extending intermediate opening 100 disposed therein, and has a second end portion 99. The intermediate moveable link also has an intermediate cooperating portion 102 having an upstanding wall portion 104, a top portion 106 and an intermediate projection 108.

Further secured to the main portion 96 is a second magnet 110 having a South pole, facing upwardly relative to the main portion 96.

The intermediate moveable link further includes an intermediate resilient elastic member 112 having a first end portion 114 connected to the first upstanding wall portion 36, a second end portion 116 connected to the second upstanding wall portion 38 and an intermediate portion 118 extending around a portion of the second magnet 110.

The first and second upstanding wall portions 36 and 38, immediately adjacent the second end portion 116 are formed with respective intermediate transverse channel tabs 194 which interfere with the main portion 96 and with the upstanding wall portion 104, to prevent the intermediate link 46 from lifting out of the channel member 34 during movement of the link and to limit the travel of the link. While the intermediate transverse channel tabs 194 perform these functions, they permit sufficient rotational movement of the first end portion 98 relative to the second end portion 99 to allow the intermediate link to engage with the primary link as will be appreciated below. The first end portion 98 therefore acts as an intermediate moveable portion of the intermediate link.

FIG. 2

Figure 2:
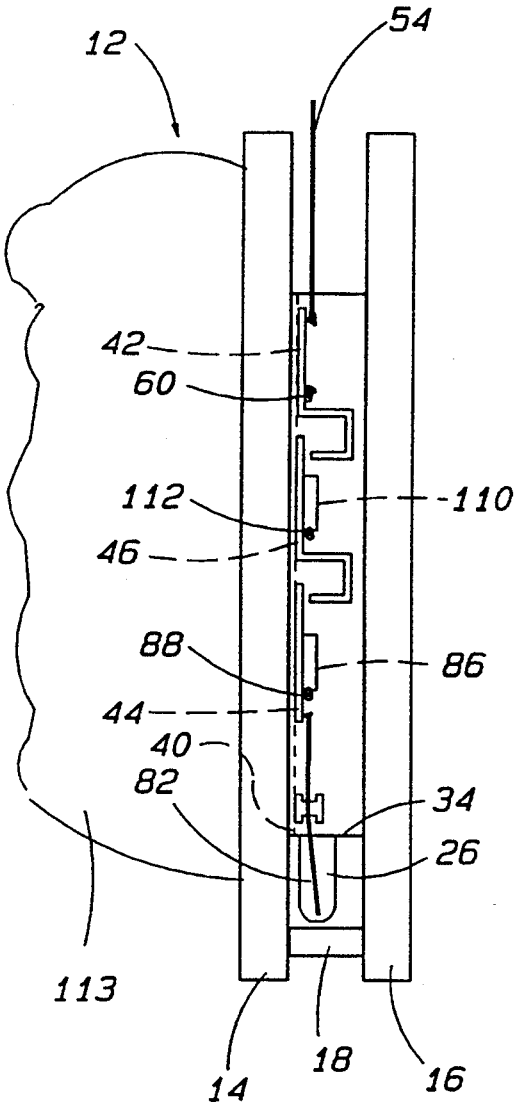
FIG. 2 is a side view of the apparatus of FIG. 1.

Referring to FIG. 2, the apparatus 12 is shown in a vertical position with the primary, secondary and intermediate links 42, 44 and 46 respectively, in respective home positions. Preferably, the apparatus is secured to an object 113 containing ferrous metal, with the ferrous metal being beneath the plate portion 40 of the channel member 34, such that the first and second magnets tend to be forced against the plate portion 40. This keeps the links out of engagement when in the home position shown in FIG. 2.

FIG. 3

Figure 3:
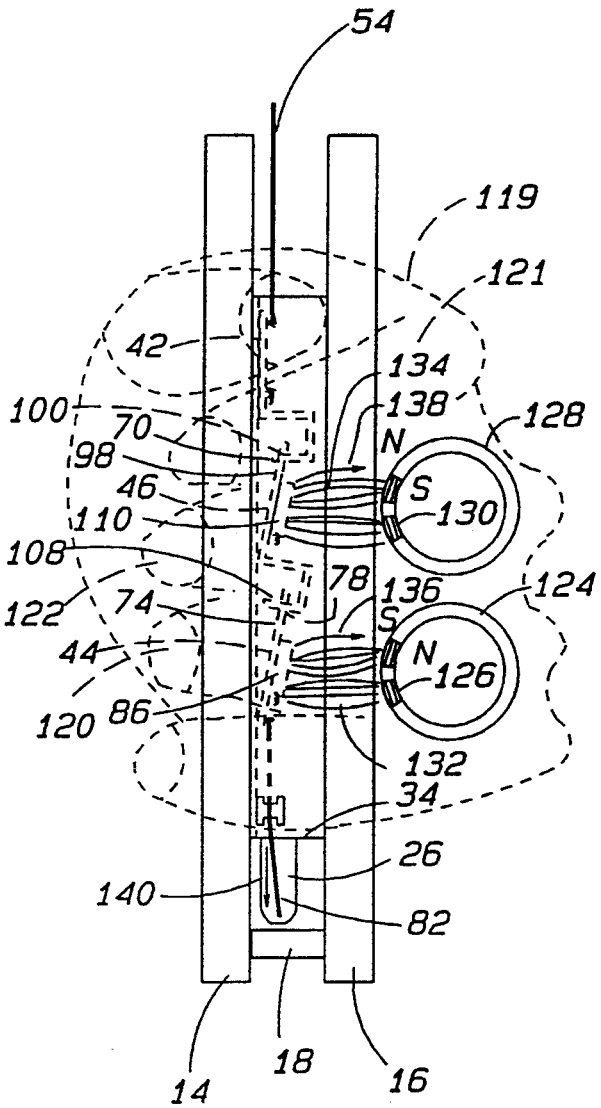
FIG. 3 is a side view of the apparatus of FIG. 1 shown in an energized position whereby links according the apparatus are coupled together.

Referring to FIG. 3, a hand of a user is shown in broken outline at 119, the hand having first and second fingers 120 and 122. On the first finger 120, the user wears a ring 124 having a first cooperating magnet 126 secured thereto such that the South pole faces radially outwardly, away from the finger 120 and the North pole of the magnet faces radially inwardly toward the finger 120. Similarly, on the second finger 122 the user wears a second ring 128 having a second cooperating magnet 130 secured thereto, the second magnet having a North pole facing radially outwardly and a South pole facing radially inwardly relative to the finger 122. In effect therefore, the first magnet 86 and the first cooperating magnet 126 have opposite polarity. A similar situation exists for the second magnet 110 and the second cooperating magnet 130.

Referring to FIGS. 1 and 3, the secondary actuator 20 and the secondary and intermediate links 44 and 46 are positioned on the apparatus such that the user can simultaneously position the first and second cooperating magnets 126 and 130 adjacent the second and intermediate moveable portions respectively and actuate the second actuator, all using only one hand. It should be apparent that the secondary actuator 20 is actuated by squeezing pressure applied by the hand of the user.

Operation

Referring to FIG. 3, as seen in broken outline, between the first and second plates 14 and 16, the first and second cooperating magnets 126 and 130 present to the secondary and intermediate links, respective first and second magnetic fields 132 and 134 which pass through the second plate 16 to cause attraction of the first and second magnets 86 and 110 respectively.

The influence of the first and second magnetic fields attracts the first and second magnets 86 and 110 and the first and second upstanding wall portions 36 and 38 of the channel member permit movement of the secondary moveable portion in a direction perpendicular to the movement plane. The first and second magnetic fields act as controlling means which imparts a force sufficient to impart movement to the secondary and intermediate moveable portions in a direction perpendicular to a movement plane parallel to the plate portion of the channel member, while the second end portions 76 and 99 remain relatively stationary due to the secondary and intermediate channel tabs 192 and 194, as seen best in FIG. 4. Referring back to FIG. 3, this causes the secondary link and the intermediate link to rotate about their respective second end portions in the direction of arrows 136 and 138 respectively. The rotation of the secondary link 44 is sufficient to cause the first end portion 74 to rotate towards the second plate 16 whereby the intermediate projection 108 is received in the secondary opening 78. Similarly, the first end portion 98 of the intermediate link is rotated toward the second plate 16 such that the primary projection 70 is received in the intermediate opening 100. With the projections 70 and 108 in respective openings 100 and 78, the primary, secondary and intermediate links 42, 44 and 46 are coupled together. The first and second cooperating magnets 126 and 130 therefore act as controlling means for controlling the engagement and disengagement of the primary, secondary, and intermediate links.

Referring to FIGS. 1 and 3, when the user squeezes his hand 19, it will be appreciated that the first end portion 24 of the secondary actuator 20 is pushed in the direction of arrow 28 shown in FIG. 1. The secondary flexible tension link 82 is therefore pulled downwards, by the second end portion 26, in the direction of arrow 140 such that this downward movement is transferred to the primary flexible tension link 54 and hence to the primary actuator 10, by movement of the engaged moveable links. As tension is applied to the secondary flexible tension link, the engaged moveable links are guided in linear movement by the first and second upstanding wall portions 36 and 38 of the channel member 34. The channel member therefore acts as guiding means for guiding the movement of the primary, secondary and intermediate moveable links along a predefined path in the movement plane.

FIG. 4

Figure 4:
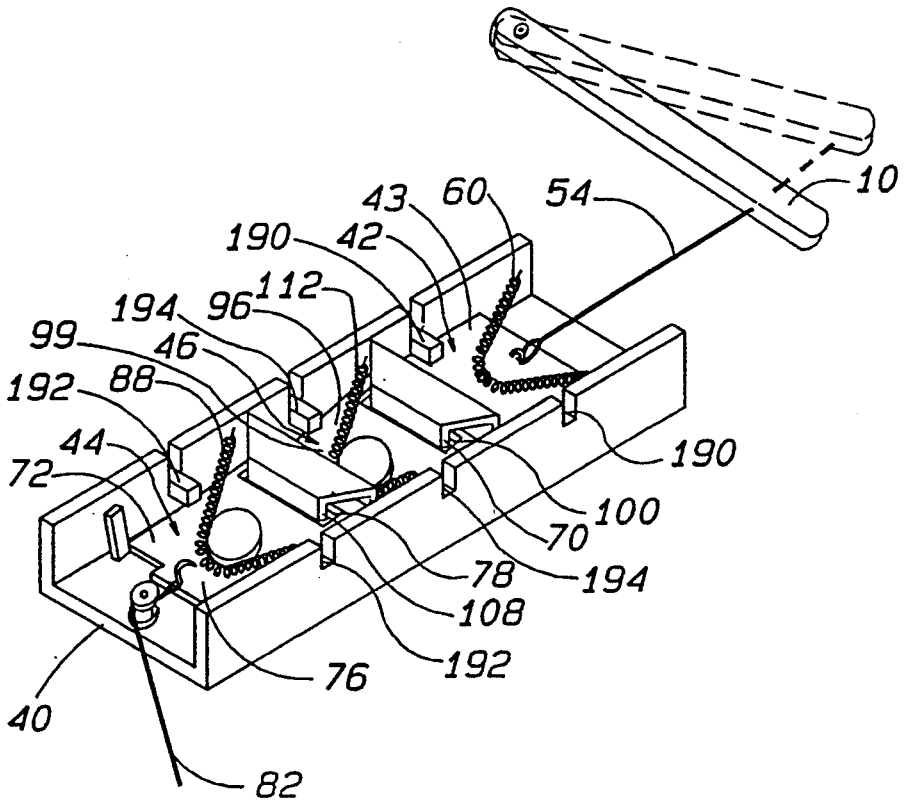
FIG. 4 is a simplified perspective view of a link assembly according to the invention, illustrating movement of the links into an actuated position.

Referring to FIG. 4, the primary, secondary and intermediate links are shown coupled together with the secondary flexible tension link 82 at a limit of travel and with the primary flexible tension link 54 shown pulled downwards such that the primary actuator 10 is moved from the home position shown in broken outline to the position shown in solid outline. It will be appreciated that when the moveable links are coupled together and the secondary actuator 20 is actuated, the elastic members 60, 88 and 112 are stretched due to movement of the links, such that the primary, secondary and intermediate links are biased back into the home position as shown in FIG. 1. When the secondary actuator 20 is released, the primary, secondary and intermediate links are returned to the home position as shown in FIG. 1, by the elastic members 60, 88 and 112. These elastic members therefore act as biasing means for biasing the primary, secondary, and intermediate links into the home position.

It will be appreciated that the primary, secondary and intermediate transversely extending channel tabs 191, 192 and 194 are spaced apart from the plate portion 41 such that the links can move linearly along the channel without becoming disengaged by the camming action of the channel tabs on respective main portions 43, 72 and 96 as the links are moved.

FIG. 5

Figure 5:
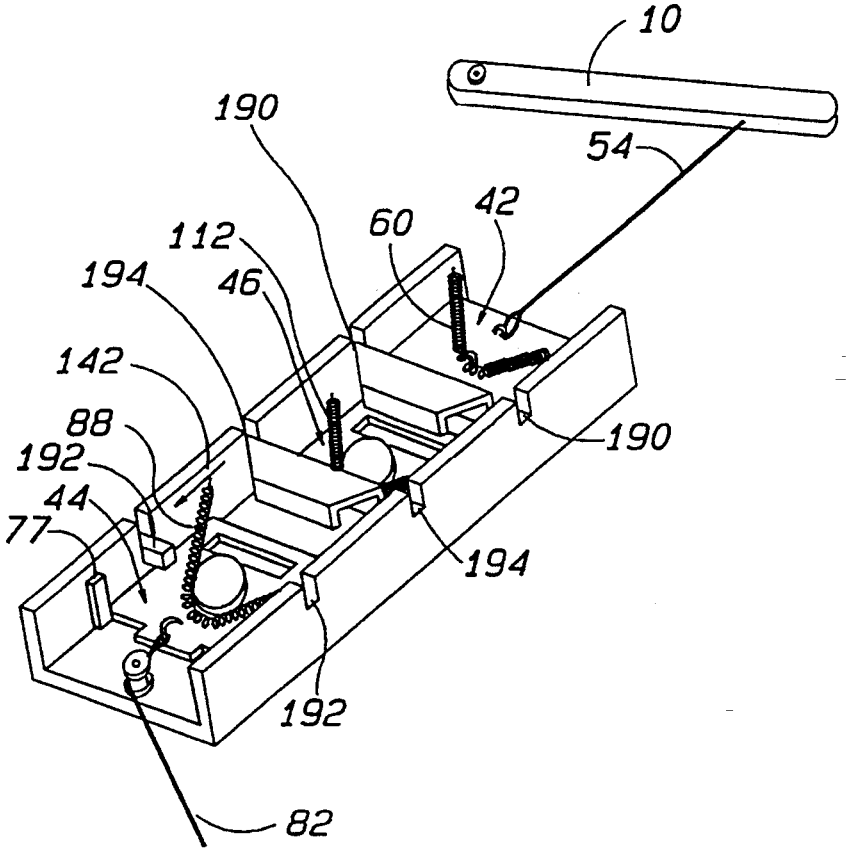
FIG. 5 is a simplified perspective view of the link assembly shown in a de-energised, unactuated, home position.

Referring to FIG. 5, when the first and second cooperating magnets 126 and 130 are not disposed adjacent the secondary and intermediate links respectively, the links return to the position shown in FIG. 2 whereby none of the links is engaged with another. Upon applying tension to the secondary flexible tension link 82 by the secondary actuator 20 shown in FIG. 1, only the secondary moveable link 44 moves in the direction of arrow 142, the primary moveable link 42 and the intermediate moveable link 46 remaining stationary. Since the primary link remains stationary, no tension is applied to the primary flexible tension link 54 and therefore there is no actuation of the primary actuator 10. Releasing the secondary actuator 20 releases the tension on the secondary flexible tension link 82 and permits the secondary moveable link 44 to move in a direction opposite to arrow 142 under the influence of elastic member 88 until the upstanding tabs 77 interfere with the secondary channel tabs 192, whereupon the secondary link is considered to be in the home position.

FIG. 6

Figure 6:
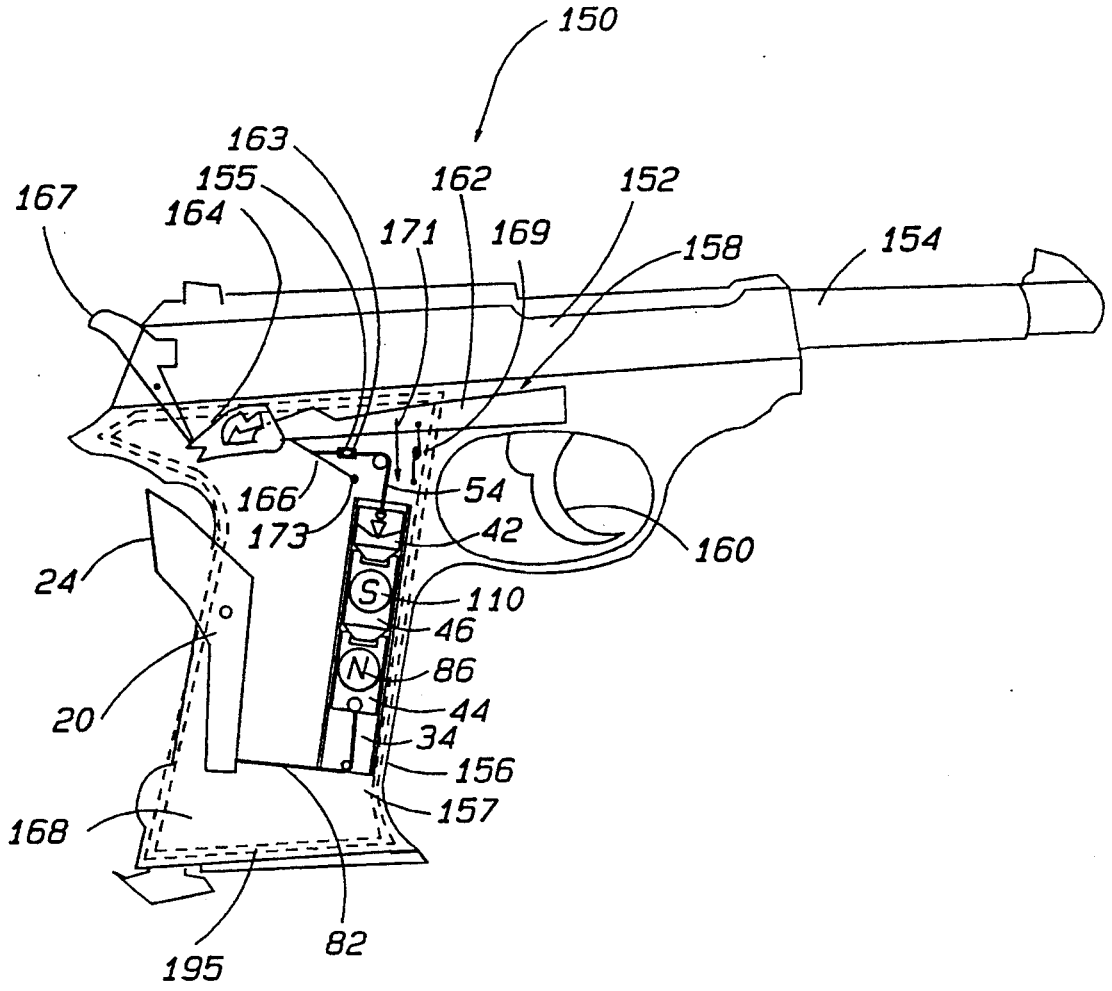
FIG. 6 is a side view of a gun having an apparatus as described with respect to the first embodiment installed therein for controlling the engagement of a trigger bar with a sear of said gun.

Referring to FIG. 6, a gun employing a variation of the apparatus shown in FIGS. 1–5 is shown generally at 150. The gun includes a body 152 having a barrel portion 154, a handle portion 156, a grip panel 195 and a firing mechanism shown generally at 158. The firing mechanism includes a trigger 160, a trigger bar 162, a sear 164 a hammer 167 a spring 169 and a leaf spring 166.

Normally, the gun is manufactured with the spring 169 installed to act in compression which serves to hold the trigger bar 162 into engagement with the sear 164. To use the invention in this application, the spring 169 is used in extension to bias the trigger bar 162 in the direction of arrow 171, out of engagement with the sear 114. The leaf spring 166 is added to the gun as manufactured and is secured thereto by a pivot pin 173. Rotation of the leaf spring about the pivot pin causes the leaf spring to push the trigger bar 162 upwards, against the resisting force of the spring 169 and into engagement with the sear 164. In connection with the embodiment described above, the leaf spring 166 assumes the role of the primary actuator 10 referred to in the figures above.

In this embodiment, the apparatus described in connection with FIGS. 1–5, has been modified such that the actuator is on an opposite side of the channel member. Otherwise, the components and operation of the apparatus are the same as described in FIGS. 1–5. Therefore, the same terms and numerical reference numbers will be used to describe components corresponding to components described in FIGS. 1–5.

The channel member 34 is mounted in a hollow portion 168 between the handle portion 156 and the grip panel 195 such that it extends generally longitudinally thereof, near a forward edge 157 of the handle such that the cooperating magnets 126 and 130 worn on the fingers 120 and 122 of an operator will be positioned as close as possible to the first and second magnets 86 and 110 on the second and intermediate links 44 and 46 respectively when the operator grips the handle. With the gun illustrated, it will be understood that the operator's index finger 121 (seen best in FIG. 3) is intended to operate the trigger while the first and second rings are intended to be worn on the fourth and middle fingers respectively, of the same hand.

The secondary actuator 20 is also secured to the hollow portion of the handle portion 156 such that the first end portion 24 projects outwardly therefrom and such that it is operable to be contacted by the area between an operator's forefinger and thumb when the handle portion is gripped, while the fourth and middle fingers place the first and second cooperating magnets in the above described positions adjacent the secondary and intermediate links.

The leaf spring 166 is connected to the primary link 42 by the primary flexible tension link 54 and the secondary actuator 20 is connected to the secondary link by the secondary flexible tension link 82. Thus, when the links are engaged, movement of the secondary actuator 20 is transferred to the leaf spring 166 which is pushed against the trigger bar 162 to engage the trigger bar with the sear 164, thereby enabling the gun 150 to be fired upon pulling the trigger 160.

Conversely, when the links are not engaged, only the secondary link 44 is moved by the secondary actuator 20, while the intermediate and primary links 46 and 42 and the primary flexible tension link 54 and the leaf spring 166 remain stationary and thus the trigger bar 162 is not engaged with the sear 164.

It will be appreciated that conventional guns have handles formed from metal or other ferromagnetic materials and therefore, magnets used on the links are attracted to portions of the handle. This effect can be minimized by mounting the first and second magnets on first and second ferrous plates (not shown) disposed between respective magnets and the links.

Operation of the gun 150 is achieved by placing the first and second rings (not shown in FIG. 6, see FIG. 3) carrying the first and second cooperating magnets respectively, on first and second fingers 120 and 122 respectively of a hand of an operator. Next, the operator grips the handle portion 156 such that the operator's index finger is received adjacent the trigger 160 while the fourth and middle fingers place the first and second rings and hence, the first and second cooperating magnets adjacent the secondary and intermediate links 44 and 46 respectively. In this embodiment, the first and second cooperating magnets have south and north polarities respectively, and the first and second magnets 86 and 110 on the secondary and intermediate links respectively have north and south polarities respectively. Thus, when the first and second cooperating magnets are brought close to the first and second magnets respectively, corresponding magnets are attracted together such that the secondary and intermediate links 44 and 46 are moved into engagement with each other and with the primary link 42.

Next, the user squeezes his hand about the handle portion 156 to move the secondary actuator 20, whereby movement of the secondary actuator 20 is transferred to the leaf spring 166 by the primary, secondary and intermediate links 42, 44 and 46, thereby engaging the trigger bar 162 with the sear 164. The gun 151 is thus readied for use and upon pulling the trigger 160, the gun is fired in the conventional manner.

FIG. 7

Figure 7:
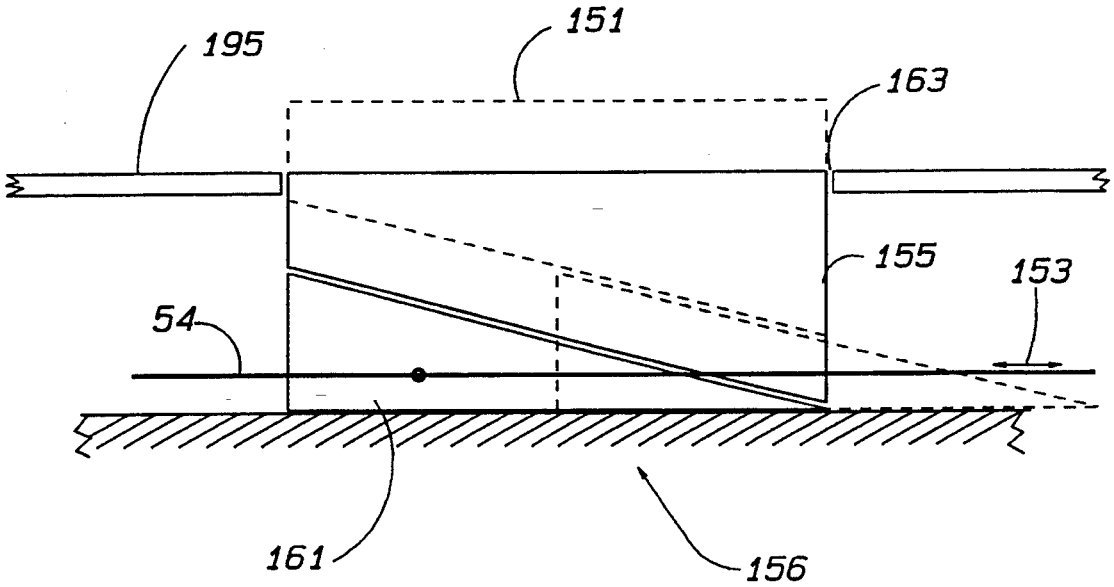
FIG. 7 is a cross sectional view of an indicator according to the invention, for indicating to a user of the gun of FIG. 6, the condition that the gun is ready for operation.

Referring to FIG. 7, with this apparatus, an indicator for indicating to the operator that the gun is ready for firing may be provided by attaching a horizontally moving wedge member 161 to the primary flexible tension link 54, providing an opening 163 in the grip panel 195 and providing a vertically moving wedge member 155 in the opening 163 and resting on the horizontally moving wedge member 161. As the primary flexible tension link is moved in the directions indicated by arrow 153, the horizontally moving wedge member 161 moves between the positions shown in broken and solid outline. As wedge member 161 moves, the vertically moving wedge member 155 is restricted in horizontal movement by the opening 163 and therefore moves vertically upwards, due to the movement of the horizontally moving wedge member, such that a portion 151 extends out of the opening 163. Referring back to FIG. 6, this portion 151 may be felt by the forefinger of the user. Thus, upon squeezing the handle, the operator can feel the wedge member 155 move in the opening 163 thereby receiving feedback that the gun is ready to fire. The wedge member 155 and associated apparatus therefore act as feedback means for providing feedback to an operator of the apparatus indicative of the state of readiness of the firearm, the feedback means including an indicating member, the wedge member, connected to the flexible tension link, the member having a portion protruding from the firearm in an area contacted by the operator when using the firearm, such that the operator can feel the movement of the indicating member.

Alternatives

Figure 8:
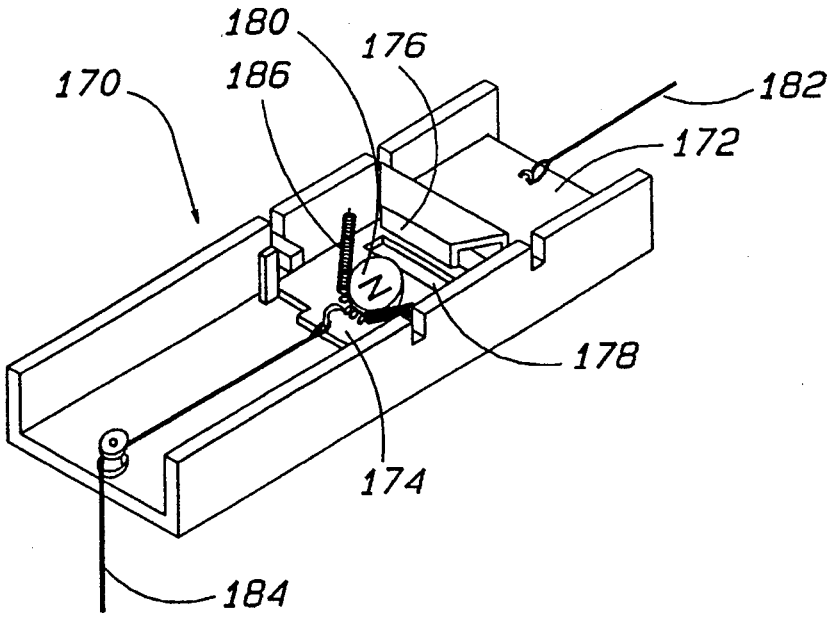
FIG. 8 is a perspective view of a link assembly according to a second embodiment of the invention with links according to said second embodiment shown in a de-energized, uncoupled, home position.
Figure 9:
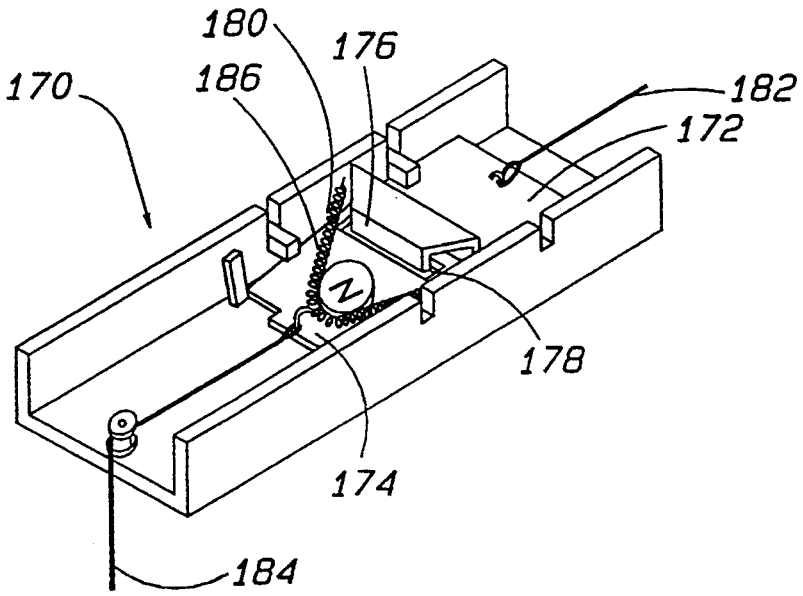
FIG. 9 is a perspective view of the apparatus of FIG. 8 shown in an energized, coupled, actuated position.

FIGS. 8 and 9

Referring to FIGS. 8 and 9 an apparatus according to a second embodiment of the invention is shown generally at 170. This apparatus is generally the same as the apparatus as shown in FIG. 1–5, with the exception that the intermediate link has been omitted and therefore the apparatus includes a primary link 172 and a secondary link 174, the primary and secondary links being engageable by receiving a primary projection 176, extending from the primary link, in a secondary opening 178 in the secondary link.

The secondary link has a first magnet 180 secured thereto, the secondary link being attracted to a first cooperating magnet as described in connection with FIG. 3, when a first ring to which the first cooperating magnet is secured, is brought into close proximity to the secondary link 174. The polarities of the first magnet 180 and the first cooperating magnet (126 in FIG. 3) are north and south respectively such that attraction occurs between them.

When the operator places a finger on which the first ring is worn adjacent the secondary link 174, the secondary link is moved relative to the primary link 172 such that the primary projection 176 is received in the secondary opening 178, whereby the primary and secondary links are engaged.

The primary link 172 is connected to a first flexible tension link 182 which may be connected to an actuator as shown in FIG. 1 and the secondary link 174 is connected to a secondary flexible tension link 184 which may be connected to a secondary actuator 20 as shown in FIG. 1. Thus, when the primary and secondary links are engaged, tension in the secondary flexible tension link, as imposed by a secondary actuator 20, causes the primary and secondary links to be moved, thereby transferring such movement to the primary flexible tension link and hence to a primary actuator connected to the primary flexible tension link.

FIG. 8 shows the primary and secondary links in a home position, the secondary link being biased into this home position by an elastic member 186. When the primary and secondary links are engaged and tension is applied to the secondary flexible tension link such that the primary and secondary links are moved into an operative position as shown in FIG. 9, the elastic member 186 is stretched and thus imposes a biasing force tending to return the secondary link 174 and hence also the primary link 172, to the home position shown in FIG. 8.

The apparatus described in connection with FIGS. 8 and 9 relies on simple attraction of a single link to effect engagement of the primary and secondary links whereas the apparatus described in connection with FIGS. 1–5 relies on attraction of two links which can only be achieved when the operator wears rings of a pre-defined polarity combination to match the polarity of magnets on the secondary and intermediate links respectively.

Figure 10:
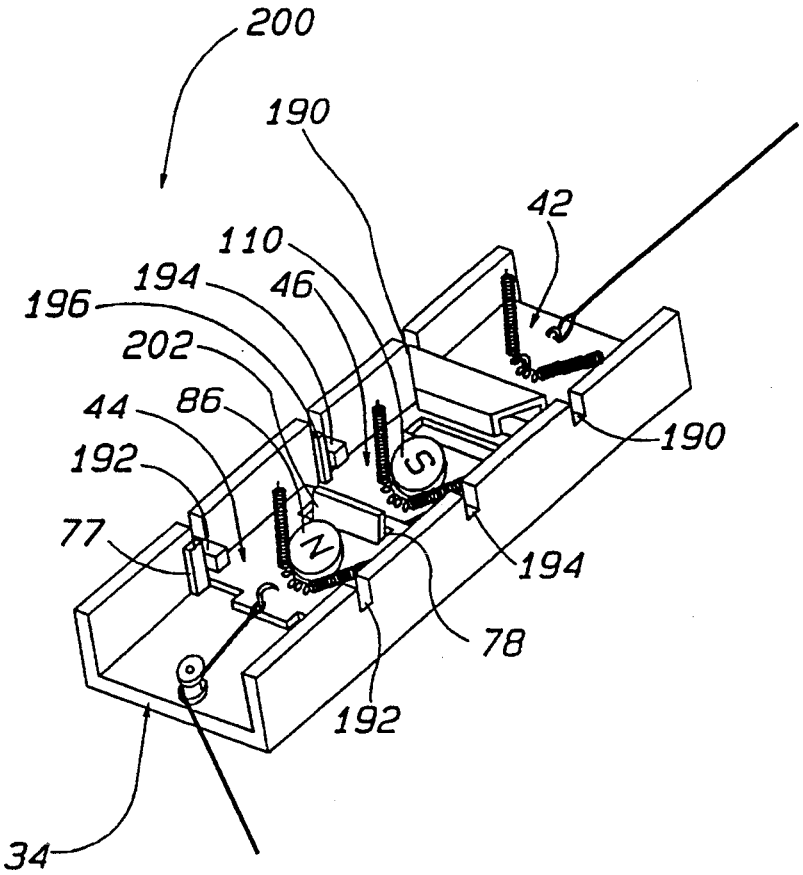
FIG. 10 is a perspective view of an apparatus according to a third embodiment of the invention, links of the apparatus being shown in a home position.
Figure 11:
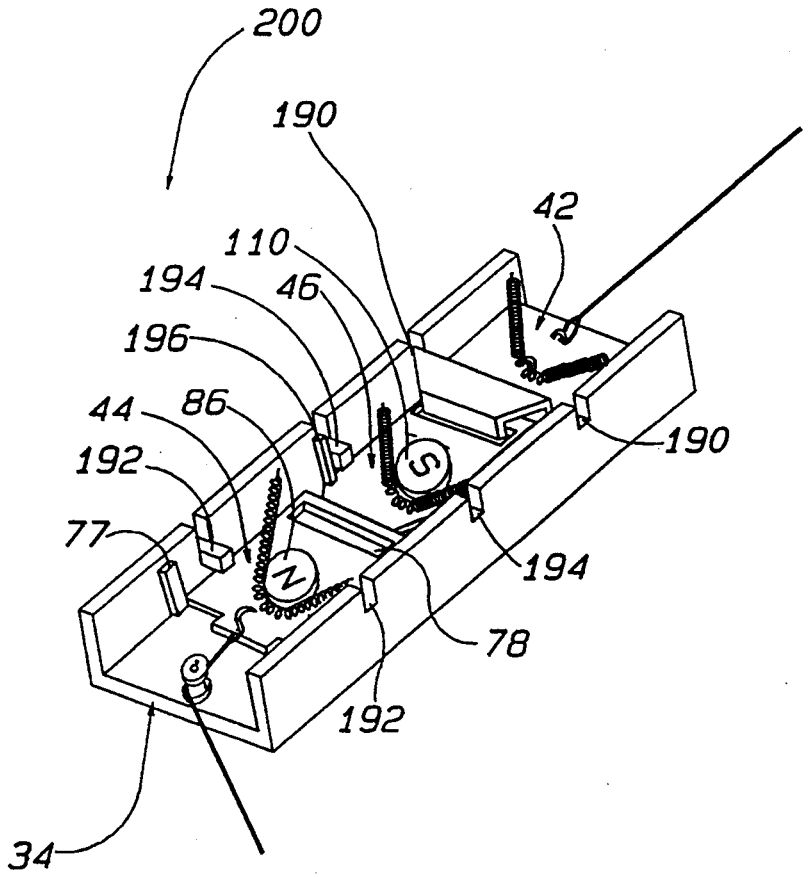
FIG. 11 is a perspective view of the apparatus of FIG. 10 wherein links of the apparatus are shown in a disengaged position.

FIGS. 10 and 11

Referring to FIG. 10, an apparatus according to a third embodiment of the invention is shown generally at 200. The apparatus 200 is generally the same as the apparatus shown in FIGS. 1–5 with the exception that the intermediate link 46 has an upwardly extending projection 202 which is received in the secondary opening 78 when the links are in the home position, the intermediate link has upstanding tabs 196 and, the secondary link 44 has a first magnet 86 having an upwardly facing North pole while the intermediate link has a second magnet 10 having an upwardly facing South pole.

This embodiment has advantages in applications where there is little ferrous material underneath the channel member 34 to cause the first and second magnets 86 and 110 to be attracted flat against the channel plate portion 40 as is normally required to keep the links out of engagement in the home position. In this embodiment, it will be appreciated that when the channel member 34 is in the orientation shown in FIG. 10, the primary and intermediate links 42 and 46 are out of engagement while the secondary and intermediate links 44 and 46 are in engagement.

Referring to FIG. 1, in the event that the apparatus is turned upside down or in the event that a user attempts to defeat the apparatus by placing a ferrous material above the channel member 34, the primary and intermediate links 42 and 46 will become engaged while the secondary and intermediate links 44 and 46 are likely to become disengaged as shown. The only way to cause all of the links to become engaged at the same time is for the user to grasp the apparatus with a hand wearing a ring having a first cooperating magnet with an outwardly facing North pole while at the same time wearing a second ring having a second cooperating magnet also with an outwardly facing North pole. The magnet on the first ring will repel the first magnet 86, tending to keep the secondary and intermediate links 44 and 46 in engagement. At the same time the magnet on the second ring will attract the second magnet 110, thereby tending to keep the primary and intermediate links 42 and 46 in engagement. It will also be appreciated that this arrangement of magnets provides greater security as only the N—N combination of magnets on rings worn by the user will cause engagement of the links. Otherwise the function of the apparatus is as described with respect to FIGS. 1–5.

It will be appreciated that while the invention has been illustrated for use with a gun, it has other uses with firearms such as providing a safety lock on a revolver, a semi automatic or automatic weapon, and has non-firearm related uses such as providing a lock on a drawer containing drugs, or providing a lock on a briefcase or a door handle.

While specific embodiments of the invention have been described and illustrated, such embodiments should be considered illustrative of the invention only and not as limiting the invention as construed in accordance with the accompanying claims.

What is claimed is:

1. An apparatus for controlling a primary actuator, the apparatus comprising:

a) a primary moveable link connected to said primary actuator;

b) a secondary actuator;

c) a secondary moveable link connected to said secondary actuator, the secondary moveable link having a secondary moveable portion engageable with said primary moveable link, d) guiding means for guiding the movement of said primary and secondary links, said guiding means including first and second spaced apart wall portions for guiding the movement of the primary and secondary moveable links along a predefined linear path in a movement plane; said first and second wall portions permitting movement of said secondary moveable portion in a direction perpendicular to said movement plane;

e) biasing means for biasing said primary and secondary moveable links into a home position;

f) controlling means including a magnet acting on at least one of said links to cause relative movement between said primary link and said secondary moveable portion, said relative movement being in a direction perpendicular to said movement plane, for engaging and disengaging the primary and secondary links such that movement of said secondary actuator is transferred to said primary actuator when said links are engaged and movement of said secondary actuator is not transferred to said primary actuator when said links are disengaged.

2. An apparatus as claimed in claim 1 wherein said secondary moveable portion of said secondary link has a secondary opening therein and wherein said primary link has a primary projection operable to be received in said secondary opening when said secondary moveable portion is moved in said direction perpendicular to said movement plane, said primary and secondary links being engaged when said primary projection is received in said secondary opening.

3. An apparatus as claimed in claim 2 wherein said secondary moveable portion has a first magnet secured thereto.

4. An apparatus as claimed in claim 3 wherein said controlling means includes a first cooperating magnet for cooperating with the first magnet secured to the secondary moveable portion.

5. An apparatus as claimed in claim 4 wherein said controlling means includes a ring, said first cooperating magnet being connected to said ring, said ring being operable to be worn on a first finger of a hand of a user of the apparatus.

6. An apparatus as claimed in claim 5 wherein said secondary actuator and said primary and secondary links are positioned on said apparatus such that the user can simultaneously position said first cooperating magnet adjacent said secondary moveable portion and actuate said secondary actuator, all using only one hand.

7. An apparatus as claimed in claim 6 wherein said secondary actuator is actuated by squeezing pressure applied by said hand of said user.

8. An apparatus as claimed in claim 1 wherein:

a) said secondary moveable portion of said secondary link has a secondary opening therein;

b) said primary link has a primary projection extending therefrom.

9. An apparatus as claimed in claim 8 further including an intermediate moveable link disposed between the primary and secondary moveable links and guided by said guiding means, the intermediate moveable link having an intermediate moveable portion guided in movement perpendicular to said movement plane, an intermediate opening in said intermediate portion and an intermediate projection on opposite ends of the intermediate link, the intermediate opening being operable to receive the primary projection and the intermediate projection being operable to be received in the secondary opening.

10. An apparatus as claimed in claim 9 wherein said intermediate moveable portion has a second magnet secured thereto.

11. An apparatus as claimed in claim 10 wherein said controlling means subjects said intermediate moveable portion to a second magnetic field sufficient to cooperate with said second magnet to apply a force to said intermediate moveable portion, said force being sufficient to move said intermediate moveable portion in said direction generally perpendicular to said movement plane such that said primary projection is received in said intermediate opening thereby coupling said second and intermediate links together.

12. An apparatus as claimed in claim 11 wherein said first magnetic field and said second magnetic field are opposite to each other and wherein each of said magnetic fields is simultaneously applied to the secondary and intermediate moveable portions respectively to concurrently engage said secondary link with said intermediate link and said intermediate link with said primary link.

13. An apparatus as claimed in claim 12 wherein said controlling means includes a second cooperating magnet for cooperating with the second magnet secured to the intermediate moveable portion.

14. An apparatus as claimed in claim 13 wherein said controlling means includes a second ring, said second cooperating magnet being connected to said second ring, said second ring being operable to be worn on a second finger of a hand of a user of the apparatus.

15. An apparatus as claimed in claim 14 wherein said secondary actuator and said secondary and intermediate links are positioned on said apparatus such that the user can simultaneously position said first and second cooperating magnets adjacent said second and intermediate moveable portions respectively and actuate said actuator, all using only one hand.

16. An apparatus as claimed in claim 15 wherein the first and second magnets are of opposing polarity and wherein the first and second cooperating magnets are of opposing polarity.

17. An apparatus for controlling a primary actuator, the apparatus comprising:

a) a primary moveable link connected to said primary actuator;

b) a secondary actuator;

c) a secondary moveable link connected to said secondary actuator;

d) a plurality of moveable links selectively engageable with each other and with said primary and secondary moveable links; guiding means for guiding the movement of said primary and secondary links and said plurality of links along a pre-defined path;

f) controlling means for controlling the engagement and disengagement of the plurality of moveable links with each other and with the primary and secondary links whereby movement of said secondary actuator is transferred to said primary actuator when at least some of said links are engaged and movement of said secondary actuator is not transferred to said primary actuator when said some of said links are disengaged.

18. An apparatus as claimed in claim 17 wherein each of said links has a respective magnet thereon.

19. An apparatus as claimed in claim 18 wherein the controlling means includes a plurality of cooperating magnets for cooperating with respective magnets on respective moveable links to cause said links to become engaged.

20. An apparatus as claimed in claim 19 wherein the controlling means includes a plurality of rings, each of said rings having a respective cooperating magnet thereon and wherein said links and said secondary actuator are disposed relative to each other such that a user wearing said rings on respective fingers is able to place said cooperating magnets adjacent respective links to cause said at least some of said links to become engaged while operating said secondary actuator with the same hand.

* * * * *